US006185403B1

(12) United States Patent
Toyoshima et al.

(10) Patent No.: US 6,185,403 B1
(45) Date of Patent: Feb. 6, 2001

(54) SHEET CONVEYING DEVICE, AND AN IMAGE READING APPARATUS AND IMAGE FORMING APPARATUS HAVING THE SHEET CONVEYING DEVICE

(75) Inventors: Yoshio Toyoshima, Setatagaya-ku; Takeshi Iwasaki, Kasukabe; Minoru Nagasawa, Koshigaya, all of (JP)

(73) Assignee: Ricoh Company, Ltd., Tokyo (JP)

( * ) Notice: Under 35 U.S.C. 154(b), the term of this patent shall be extended for 0 days.

(21) Appl. No.: 09/348,758

(22) Filed: Jul. 7, 1999

(30) Foreign Application Priority Data

Jul. 8, 1998 (JP) ..... 10-193298
May 28, 1999 (JP) ..... 11-150722

(51) Int. Cl.[7] ..... G03G 15/00

(52) U.S. Cl. ..... 399/365; 271/902; 358/498; 399/43; 399/371; 399/406

(58) Field of Search ..... 399/361, 363, 399/365, 371, 381, 390, 388, 406, 16, 17, 43, 45, 81, 82; 271/3.14, 3.15, 3.16, 225, 264, 265.01, 902; 358/474, 494, 496, 498

(56) References Cited

U.S. PATENT DOCUMENTS 5,384,631 * 1/1995 Matsunami ..... 399/45 X
5,579,099 11/1996 Nishiyama et al. ..... 399/371
5,579,129 * 11/1996 Iwata et al ..... 358/474
5,881,350 * 3/1999 Wada et al. ..... 399/365 X

FOREIGN PATENT DOCUMENTS 5-186102 7/1993 (JP) .
5-294496 11/1993 (JP) .
7-273932 10/1995 (JP) .
8-67362 3/1996 (JP) .
8-227231 9/1996 (JP) .
10-114454 * 5/1998 (JP) .
10-301347 11/1998 (JP) .

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A sheet conveying device including a pair of rollers to convey a sheet impinged against a nip portion of the pair of rollers. Also included is a driving device which drives the pair of rollers to rotate in either a forward direction or a reverse direction, a sheet detecting device which detects the sheet inserted into the nip portion, and a controller which controls the pair of rollers to rotate in the forward direction after rotating the pair of rollers in the reverse direction by a predetermined amount of rotation, when the sheet is inserted into the nip portion of the pair of rollers.

33 Claims, 9 Drawing Sheets

SHEET CONVEYING DEVICE, AND AN IMAGE READING APPARATUS AND IMAGE FORMING APPARATUS HAVING THE SHEET CONVEYING DEVICE

BACKGROUND OF THE INVENTION

1. Field of the Invention

The present invention relates to a sheet conveying device, and an image reading apparatus such as a scanner and an image forming apparatus such as a copying machine, both provided with the sheet conveying device, and more particularly to a sheet conveying device used for conveying a sheet having a relatively large width.

2. Discussion of the Background

Typically, a sheet conveying device which is mounted on a copying machine, a scanner, and the like as an original conveying device to process an original sheet having a relatively large width, such as an D-size sheet in a lateral direction, has a configuration as illustrated, for example, in FIG. 7.

In such an original conveying device, when a user manually inserts an original P placed on an original table 81 into a nip portion between an entrance drive roller 83 and an entrance driven roller 84, the leading edge of the original P is detected by an entrance sensor 82. When the entrance sensor 82 detects the leading edge of the original P, the entrance sensor 82 is turned on and the entrance driven roller 84 is lifted up. After the leading edge of the original P passes through a clearance between the entrance drive roller 83 and the entrance driven roller 84, the leading edge of the original P is detected by a start sensor 86. Just after being detected by the start sensor 86, the leading edge of the original P impinges against a stopping nail 85. When the start sensor 86 detects the leading edge of the original P, the entrance driven roller 84 is lowered so as to again form the nip portion with the entrance drive roller 83. The stopping nail 85 also lowers down in synchronism with the lowering operation of the entrance driven roller 84 so as to allow the original P to be conveyed to a nip portion between a pair of registration rollers 87.

The original P is conveyed by the pair of registration rollers 87 through a reading position between a contact glass 88 and an exposure roller 89. While being conveyed through the reading position between the contact glass 88 and the exposure roller 89, the original P is scanned with exposure light and thereby an image of the original P is read by a reading device (not shown). The original P is then conveyed outside of the original conveying device to, for example, a sheet discharging tray (not shown), by a sheet-discharging roller 90.

An example of an original conveying device having a configuration as described above is described, for example, in Japanese Laid-open Patent Application Tokukaihei No. 6-230638.

FIG. 8 illustrates another type of an original conveying device, in which an entrance driven roller 84 is not lifted-up/lowered-down as in the aforementioned original conveying device. The original P impinges against the nip portion between the entrance driven roller 84 and the entrance drive roller 83 by being guided by a guide MYLAR 91. The guide MYLAR 91 is arranged such that one end thereof contacts an upper part of the surface of the entrance drive roller 83. The leading edge of the original P is guided by the MYLAR 91 to a position just before the nip portion between the entrance drive roller 83 and the entrance driven roller 84.

The configuration of the original conveying device is simplified by eliminating a mechanism to lift-up/lower-down the entrance driven roller 84 and the stopping nail 85.

Typically, the original conveying devices as described above include a plurality of pairs of entrance drive rollers and driven rollers as illustrated in FIG. 9A.

When the original P is manually inserted into the original conveying devices, the original P must be inserted with the leading edge straight and in parallel with a nip line, which is formed by nip portions between the plurality of pairs of entrance drive rollers 83 and entrance driven rollers 84, so that the original P is prevented from being skewed and jammed in the nip portions.

However, when the user manually inserts the leading edge of the original P into the nip portions between the entrance drive rollers 83 and the entrance driven rollers 84, as illustrated in FIG. 9A, the leading edge of the original P may not be in parallel with the nip line when the leading edge impinges against the nip portions. This is caused by the original P being caught by a surface of the entrance drive roller 83, as illustrated in FIG. 9B.

The entrance drive roller 83 is typically made of material having a relatively high frictional coefficient, such as rubber, and the original P is caught by the surface of the entrance roller 83 due to a frictional resistance between the original P and the surface of the entrance drive roller 83. Particularly, when the original P has a relatively thin thickness and has a curl, it is difficult to insert the original P so as to be accurately impinged against the nip line of the nip portions. Typically, the leading edge of such a thin original P impinges and does not form a straight line, as illustrated in FIG. 9A.

A part of the original P that is impinged against the nip portion indicated by point A may be conveyed through the nip portion A antecedently to the other parts of the original P impinging against the nip indicated by points B, as illustrated in FIG. 9A. As a result, wrinkling, jamming, and skewing of the original P tend to occur.

The original conveying device, which is provided with the stopping nail 85 as illustrated in FIG. 7 and in which the entrance driven rollers 84 are lifted up to allow the leading edge of the original P to pass through the nip portions of the plurality of the entrance drive and driven rollers so as to be impinged against the stopping nail 85, can cause the leading edge of the original P to be straight by causing the original P to impinge against the stopping nail 85 and thereby the leading edge of the original P can be accurately align at a right angle relative to the conveying direction of the original P. Therefore, wrinkling, jamming, and skewing of the original P is minimized. However, the original conveying device with the above-described configuration with the stopping nail 85, requires a mechanism to retreat the stopping nail 85 to allow the original P to be conveyed and a mechanism to lift up and lower down the entrance driven roller 84, which increases the manufacturing cost.

Also, if the original conveying device is configured to include the guide Mylar 91 contacting an upper part of the surface of an entrance drive roller 83 to cause the leading edge of the original P to accurately impinge against the nip portion, as illustrated in FIG. 8, the cost of the original conveying device is increased by the provision of the MYLAR 91. In addition, if the original conveying device provided with the guide MYLAR 91 is configured such that an original is first conveyed in a forward direction and then conveyed in the reverse direction for reading an image on the original P, the original P may be jammed at the MYLAR 91 by being interrupted with the guide MYLAR 91 when the original P is conveyed in the reverse direction. In particular, jamming of the original P may occur when the original P is repeatedly conveyed and reversed for making a plurality of copies or when the original P is discharged in the reverse direction.

SUMMARY OF THE INVENTION

The present invention has been made in view of the above-discussed problems and an object of the invention is to address and resolve these and other problems. A non-exhaustive description of the features and attributes of the invention is presented in this section, with a more complete description provided by the figures and description of the preferred embodiment section of this document.

Another object of the present invention is to provide an inexpensive novel sheet conveying device capable of preventing a sheet from being wrinkled, jammed, or skewed when the sheet is inserted into the conveying device and when it is conveyed in a forward and reverse direction in the conveying device.

Yet another object of the present invention is to provide an image reading apparatus and an image forming apparatus having the same sheet conveying device at low cost.

These and other objects may be achieved by providing a novel sheet conveying device which includes a pair of rollers configured to convey a sheet impinged against a nip portion of the pair of rollers, a driving device configured to drive the pair of rollers to rotate in either a forward direction or a reverse direction, and a sheet detecting device configured to detect the sheet inserted into the nip portion of the pair of rollers. Further, a controller controls the pair of rollers to rotate in the forward direction after rotating the pair of rollers in the reverse direction by a predetermined amount of rotation, when the sheet is inserted into the nip portion of the pair of rollers.

According to the present invention, the sheet conveying device may further include a setting device configured to set an operation of rotating the pair of rollers to rotate in the reverse direction by the predetermined amount of rotation when the sheet is inserted into the nip portion.

Further, the sheet conveying device may include an adjusting device configured to adjust the predetermined amount of rotation of the pair of rollers in the reverse direction.

The sheet conveying device may further include a guide plate configured to guide the sheet to the nip portion. In addition, at least one convex portion may be formed in the guide plate in a vicinity of the nip portion.

The convex portion may be formed at each side of the pair of rollers extending from an upstream position of the pair of rollers to the nip portion in a sheet conveying direction of the sheet conveying device.

A sheet conveying device according to another embodiment of the present invention includes a plurality of roller pairs configured to convey a sheet impinged against each nip portion thereof. The plurality of roller pairs are arranged in parallel with each other and are aligned in a direction perpendicular to a sheet conveying direction.

A novel image reading apparatus according to the present invention includes a first pair of rollers configured to convey an original impinged against a nip portion of the first pair of rollers in a pre-conveying direction and a second pair of rollers configured to convey the original having been conveyed in the pre-conveying direction in a reverse direction relative to the pre-conveying direction to a reading position, at a speed slower than when conveyed in the pre-conveying direction. An original reading device reads the original conveyed to the reading position. A driving device drives the first pair of rollers and the second pair of rollers to rotate in either a forward direction or a reverse direction. In addition, an original detecting device detects the original inserted into the nip portion of the first pair of rollers, and a controller controls the first pair of rollers to rotate in a forward direction after rotating the first pair of rollers in the reverse direction by a predetermined amount of rotation when the original is inserted into the nip portion of the first pair of rollers. The speed at which the original is conveyed in the reverse direction when the original is inserted into the nip portion of the first pair of rollers is substantially the same as that at which the original is conveyed in the reverse direction to the reading position.

Another image reading apparatus according to the present invention includes a sheet conveying device having a pair of rollers configured to convey a sheet impinged against a nip portion of the pair of rollers and a driving device configured to drive the pair of rollers to rotate in either a forward direction or a reverse direction. Also included is a sheet detecting device which detects the sheet inserted into the nip portion of the pair of rollers, and a controller which controls the pair of rollers to rotate in the forward direction after rotating the pair of rollers in the reverse direction by a predetermined amount of rotation, when the sheet is inserted into the nip portion of the pair of rollers.

A novel image forming apparatus according to the present invention includes a sheet conveying device having a first pair of rollers configured to convey an original impinged against a nip portion of the first pair of rollers in a pre-conveying direction, a second pair of rollers configured to convey the original having been conveyed in the pre-conveying direction in a reverse direction relative to the pre-conveying direction to a reading position, at a speed slower than when conveyed in the pre-conveying direction. Further, an original reading device reads the original conveyed to the reading position, and a driving device drives the first pair of rollers and the second pair of rollers to rotate in either a forward direction or a reverse direction. An original detecting device detects the original inserted into the nip portion of the first pair of rollers, and a controller controls the first pair of rollers to rotate in a forward direction after rotating the first pair of rollers in the reverse direction by a predetermined amount of rotation when the original is inserted into the nip portion of the first pair of rollers. The speed at which the original is conveyed in the reverse direction when the original is inserted into the nip portion of the first pair of rollers is substantially the same as that at which the original is conveyed in the reverse direction to the reading position.

Another image forming apparatus according to the present invention includes a sheet conveying device having a pair of rollers configured to convey a sheet impinged against a nip portion of the pair of rollers, and a driving device configured to drive the pair of rollers to rotate in either a forward direction or a reverse direction. A sheet detecting device detects the sheet inserted into the nip portion of the pair of rollers, and a controller controls the pair of rollers to rotate in the forward direction after rotating the pair of rollers in the reverse direction by a predetermined amount of rotation, when the sheet is inserted into the nip portion of the pair of rollers.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DESCRIPTION OF THE PREFERRED EMBODIMENTS

Figure 1:
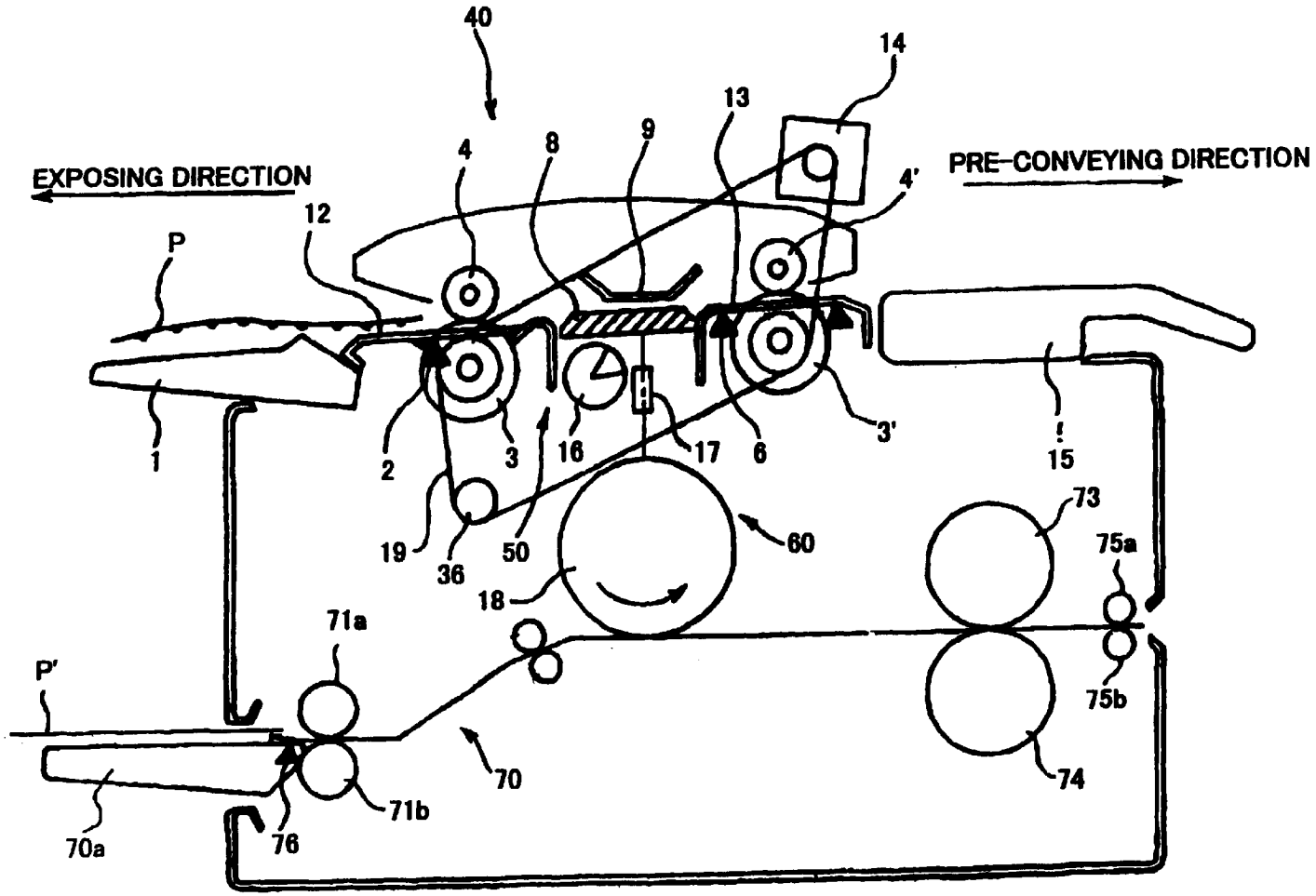
FIG. 1 illustrates a configuration of an original conveying device as a sheet conveying device according to a first embodiment of the present invention.

The preferred embodiments of the present invention are now described in detail referring to the drawings, wherein like reference numerals indicate identical or corresponding parts throughout the several views.

First Embodiment

A copying machine, provided with an original conveying device as a sheet conveying device, in which the present invention is applied, is described as the first embodiment of the present invention. However, the present invention can be applied to other image forming apparatuses, such as a facsimile machine or the like, or image reading apparatuses, such as a scanner or the like.

Referring to FIG. 1, the copying machine includes an original conveying device 40 that conveys an original P, which is manually inserted into the original conveying device 40 by a user from a left side of the main body of the copying machine in FIG. 1, in a forward and a reverse direction.

The copying machine further includes an original reading device 50 as a reading section that reads an image surface of the original P beneath a middle portion of the original conveying device 40 in an original conveying direction. The copying machine also includes a recording sheet conveying section 70 that conveys a recording sheet P' in synchronism with an operation to read the original P. The recording sheet P' is manually inserted from a front side (left side in FIG. 1) of the main body of the copying machine by the user. Alternatively, a roll-sheet may be fed from a roll-sheet supplying device (not shown) and may be cut into a rectangular shape on the basis of a length of the original P in a conveying direction, along the way of the recording sheet P' to be fed from the roll sheet supplying device to an image forming section 60. The image forming section 60 records image information of the original P onto the recording sheet P'.

The original conveying device 40 includes an original table 1 to place a relatively large sized original P and a front guide plate 12 that guides the original P into the original conveying device 40. The conveying device 40 also includes a plurality of first roller pairs of an entrance drive roller 3 (hereinafter referred to as a roller 3) and an entrance driven roller 4 (hereinafter referred to as a roller 4). The rollers 3 and 4 convey the original P, which is manually inserted into the nip portion formed by the plurality of first roller pairs from the original table 1 by the user, towards a contact glass 8 which is positioned after the roller 3 above the reading device 50. The rollers 3 and 4 convey the original P by sandwiching the original P and rotating in a forward or reverse direction.

The original conveying device 40 further includes a plurality of second roller pairs of a post drive roller 3' and a post driven roller 4' that receives the original P conveyed from the first roller pairs and further conveys the original P towards a rear side (a right side in FIG. 1) of the main body of the copying machine as a pre-conveying operation. The original conveying device 40 further includes an entrance sensor 2, as a sheet detecting device (i.e., an original detecting device), which detects a leading edge of the inserted original P at the front side of the original conveying device. In addition, a start sensor 6 is positioned just before the post drive roller 3' to detect a trailing edge of the original P. The original P, which is manually inserted in the original conveying device 40, is conveyed in a forward direction as a pre-conveying operation. Then, the original P is conveyed in the reverse direction for reading an image of the original P and discharging the original P. The pre-conveying operation is performed for the purpose of discharging the original P to the front side of the copying machine, where the user can easily handle the original P.

The pre-conveying operation starts when the entrance sensor 2 detects the leading edge of the inserted original P and ends when the start sensor 6 turns off by detecting a trailing edge of the original P. When the start sensor 6 turns off, the rotating direction of both of the first roller pairs and the second roller pairs is changed from the forward direction to the reverse direction (i.e., from a pre-conveying direction to the reading and discharging direction). Then, the original P is conveyed to the reverse direction towards the reading device 50.

In an initial stage of the pre-conveying operation, the roller 3 rotates in the reverse direction so that the leading edge of the original P will be accurately impinged against the nip portion of the plurality of first roller pairs.

The original conveying device 40 further includes an exposure guide plate 9 that guides the original P to contact a surface of the contact glass 8, and a post guide plate 13, located between the contact glass 8 and a post original table 15, to guide the original P to both the contact glass 8 and the post original table 15, respectively. The post original table 15 receives the original P conveyed thereto by the pre-conveying operation.

The rollers 3 are made of hard rubber or the like and have a frictional resistance sufficient to hold the leading edge of the original P that touches the surface of the roller 3, when the roller 3 rotates in the reverse direction described above (particularly, when the original P has a so-called face-down curl).

A timing belt 19 is movably spanned around timing pulleys mounted on respective roller shafts of the rollers 3 and the post drive rollers 3', a shaft of an original motor 14 as a driving device, and a roller shaft 36. The original P is conveyed by a driving force of the original motor 14 via the rollers 3, the rollers 4, the post drive rollers 3', and the post driven rollers 4' at a predetermined timing. The original motor 14 is driven on the basis of an output signal generated by a controller 31 as a control device, described later and illustrated in FIG. 2.

The original reading device 50 disposed just beneath the contact glass 8 includes a known exposure lamp such as a fluorescent lamp 16, mirrors (not shown), a full-size lens array 17, and the like. The original reading device 50 is configured so as to read a surface of the original P at a predetermined reading position.

The recording sheet conveying section 70 includes a recording sheet entrance sensor 76 that detects a presence or absence of the recording sheet P', a pair of rollers including a recording sheet entrance drive roller 71*b* and a recording sheet entrance driven roller 71*a* that is disposed in parallel with each other to convey the recording sheet P' to a photoconductor drum 18 at a predetermined timing. The conveying section 70 also includes a fixing roller 73 and a pressure roller 74 to fix an image to the recording sheet P' after a developing operation and a transferring operation, a pair of rollers including a discharge drive roller 75*b* and a discharge driven roller 75*a* to discharge the recording sheet P', after the image is fixed thereupon, to a sheet discharging tray (not shown).

The aforementioned recording sheet entrance drive roller 71*b* and the recording sheet entrance driven roller 71*a* are driven with a recording sheet drive motor (not shown) in either the forward or the reverse direction. The recording sheet drive motor rotates on the basis of an output signal generated by the controller 31.

In addition, the image forming section 60 includes non-illustrated image forming devices, such as a charging device, a developing device, a transfer-and-separation device, a cleaning device, a discharging device, and the like, which are disposed around the photoconductor drum 18.

Figure 2:
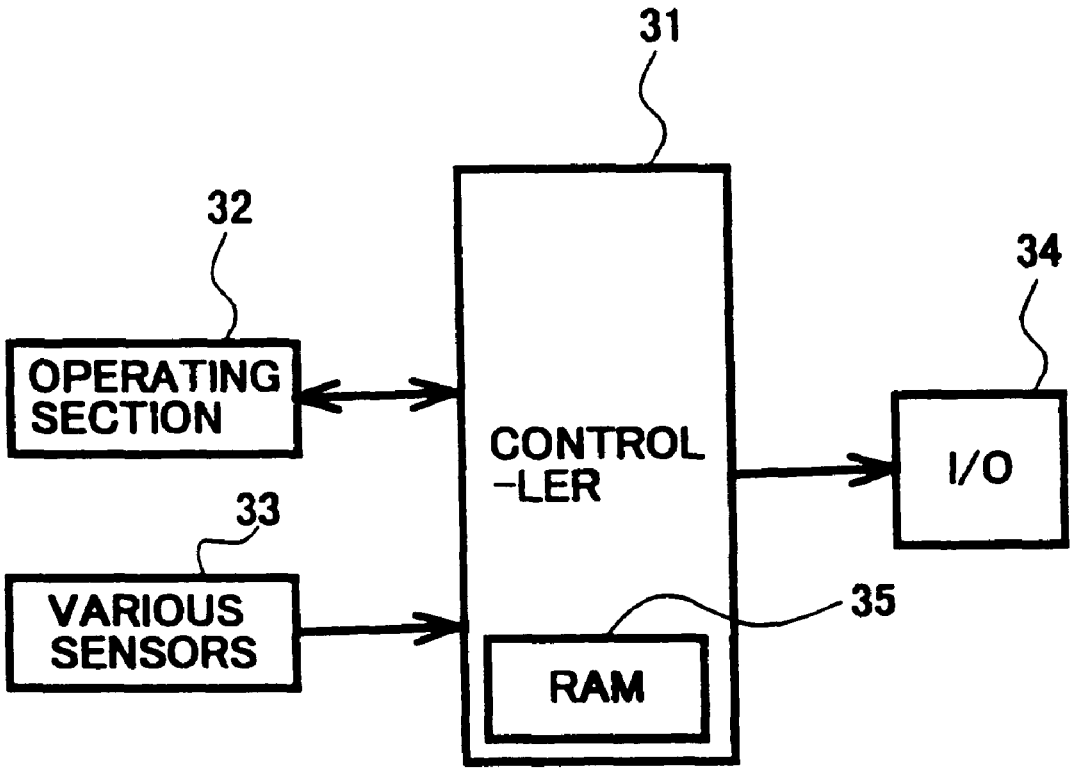
FIG. 2 illustrates a controller of the original conveying device of FIG. 1.

Referring to FIG. 2, the controller 31 includes a non-illustrated CPU and memories. A setting signal of each operation mode such as, for example, a repeat mode to perform copying operations for a plurality of copies, which is input from an operating section 32, detecting signals from various sensors 33 including the entrance sensor 2, the start sensor 6, and the like, are input to the controller 31. The controller 31 outputs signals via an input/output port 34 that turn on and off the original motor 14, the exposure lamp 16, a recording sheet motor (not shown), and the like, respectively, on the basis of information of the aforementioned input signals and a clock signal. Thereby, the controller 31 controls operations of the copying machine, including an original conveying operation, a reading operation for the original P, and the image forming operation, at corresponding predetermined operation speeds, respectively.

The operating section 32 includes various keys, which are not shown, such as a start/stop key, a ten-key pad, a function key, a YES/NO key, a cursor key, a plus/minus key to give an instruction of increasing or decreasing an amount of a reverse rotation of the roller 3 to the controller 31, which is described later, and displays constructed with an LCD, an LED, or the like, which are also not shown.

A value that indicates an amount of reverse rotation of the roller 3 in the pre-conveying operation is pre-set in a predetermined area of a RAM 35 of the controller 31. In this embodiment, a time value N based on which the roller 3 starts to rotate in the reverse direction in the pre-conveying operation is pre-set. The controller 31 controls the reverse rotation of the roller 3 such that when the original P is manually inserted into the original conveying device 40, the roller 3 starts to rotate in the reverse direction N milliseconds before a starting time of forward rotation in the pre-conveying operation. In this embodiment, the default value N stored in the RAM 35 is set to 250 ms. The value N is determined depending on the diameter and rotating speed of the roller 3 and the configuration of the original conveying device 40 relating to the original conveying speed, such as for example, inclination of the front guide plate 12 and so forth.

When the drive motor, i.e., the original motor 14, is a stepping motor or the like, the number of driving steps i.e., the number of pulses, may represent the amount of the reverse rotation of the roller 3. When the drive motor is a stepping motor, a moving distance of a circumferential surface of the rotating roller 3 can easily be calculated from the number of steps multiplied by the moving distance per one step of the rotation of the stepping motor.

When the user does not wish to perform the reverse rotation of the roller 3 before the forward rotation of the roller 3, the value N can be rewritten to zero so as not to perform the reverse rotation of the roller 3 by using corresponding input keys of the operating section 32. Thus, the user can select between setting and not setting the reverse rotation of the roller 3 in the RAM 35.

For example, if the original P is thick and stiff enough to be inserted into the nip portions between the rollers 3 and corresponding rollers 4 with the leading edge of the original P kept straight and in parallel with the nip line of the nip portions, it is not necessary to perform the reverse rotation of the roller 3.

Furthermore, the controller 31 controls an original insertion timer (not shown). The original insertion timer is provided to set an interval time between the time when the entrance sensor 2 is turned on and the time when the pre-conveying operation in the forward direction is started. The interval time set in the original insertion timer is about 2 seconds in this embodiment. The time is provided to give the user an allowance of time to accurately set an original P, i.e., a time to adjust the leading edge of the original so as to be impinged against the nip line between the rollers 3 and corresponding rollers 4 in parallel with the nip line. The reason why the aforementioned time is provided is that the original P, particularly, the original P having a relatively large width, is difficult to be accurately inserted into the nip portion (i.e., to be inserted in parallel with the nip line between the rollers 3 and corresponding rollers 4).

The above time set in the original insertion timer may be adjusted to be relatively short or long depending on a user's operating skill and a size of the original P, via the aforementioned operating section 32.

When the original P is detected by the entrance sensor 2, and when the time value N for the reverse rotation of the roller 3 is set in the predetermined area of the RAM 35, the original motor 14 starts to rotate in the reverse direction at the time corresponding to the set value N before the starting time of forward rotation. When the interval time set in the original insertion timer is expired, the original motor 14 rotates in the forward direction and the original P is conveyed in the forward direction.

Thereafter, the leading edge of the original P turns on the start sensor 6, and further the original P is conveyed until the start sensor 6 detects the trailing edge of the original P. When the start sensor 6 detects the trailing edge of the original P, the rotating direction of the original motor 14 is changed from the forward direction to the reverse direction and the original motor 14 is rotated in the reverse direction. In addition, the controller 31 controls to drive the recording sheet motor and to light the exposure lamp 16 in synchronism with the rotation of the original motor 14.

A setting device that sets an operation to start to rotate the roller 3 in the reverse direction a certain time before rotating the roller 3 in the forward direction includes the controller 31 and the operating section 32 in the embodiment.

Figure 3:
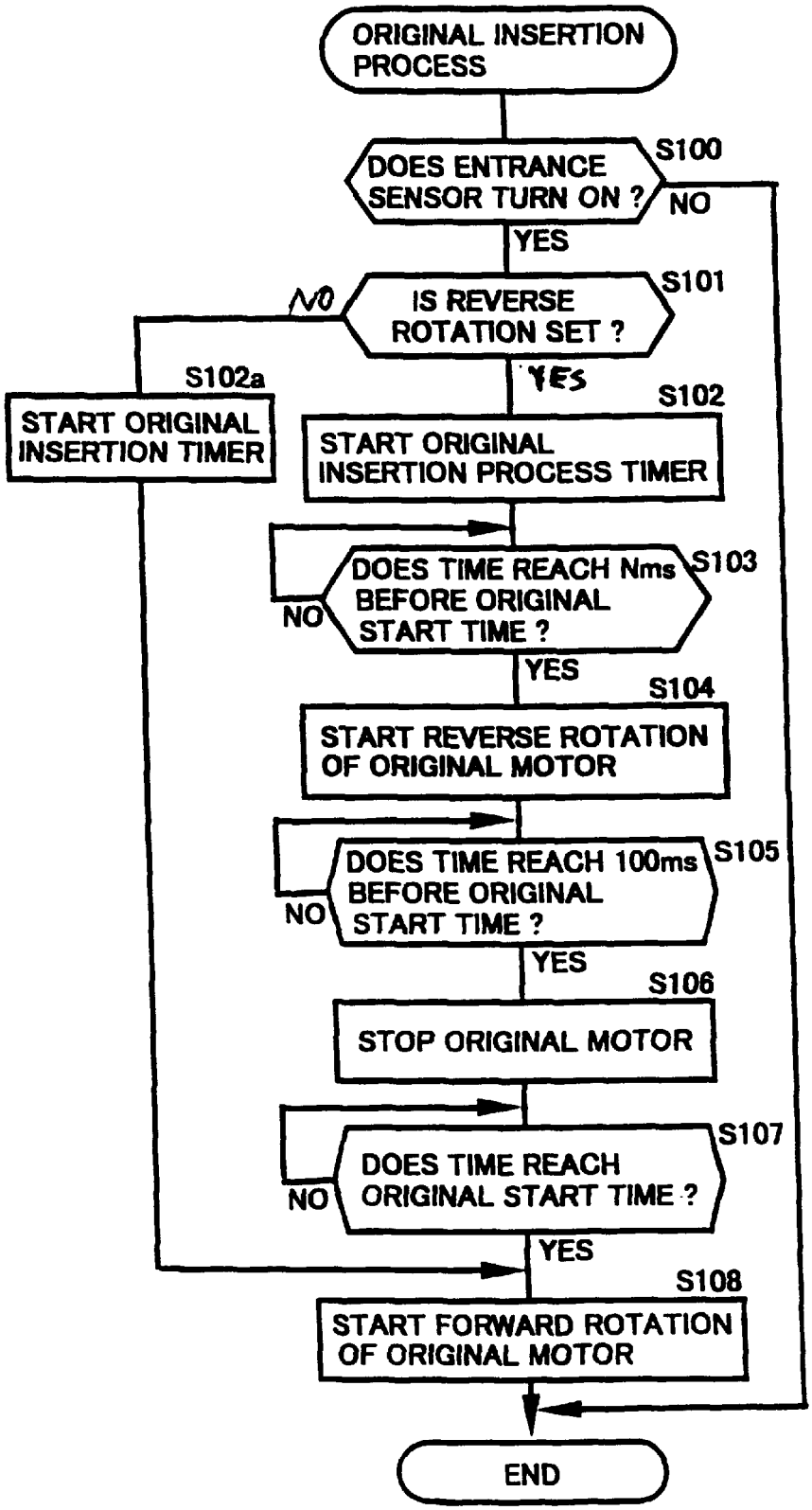
FIG. 3 is a flowchart illustrating an original insertion process of the original conveying device.

Next, an original insertion process is explained referring to FIG. 3.

When a sheet of the original P on the original table 1 is manually inserted from the front side (left side in FIG. 1) of the main body of the copying machine by the user, the entrance sensor 2 is turned on by detecting the leading edge of the inserted original P (YES in Step S100). After the entrance sensor 2 is turned on (YES in Step S100), the controller 31 checks whether the reverse rotation of the roller 3 is set (Step S101), namely, the controller 31 checks whether a time value N for the reverse rotation of the roller 3 is stored in the RAM 35.

If the value N is absent (NO in Step S101), the controller 31 starts the original insertion timer and waits until the original insertion timer reaches a predetermined count (Step S102*a*) and then starts rotation of the original motor 14 in a forward direction (Step S108). When the original insertion timer reaches the predetermined count, the controller 31 ends the original insertion process.

When the reverse rotation is set (YES in Step S101), the controller 31 also starts the original insertion timer and reads out the value of N from the RAM 35 (Step S102). When a time, which is calculated by subtracting the value N from the interval time set in the original insertion timer, has passed (Yes in Step S103), the original motor 14 starts the rotation in the reverse direction (Step S104) at an exposing speed, i.e., an image reading speed, which is slower than the pre-conveying speed.

In this embodiment, the interval time is set to 2 sec and the value N is set to 250 ms, and therefore the aforementioned time becomes 1750 ms. As described earlier, the interval time is provided for the user to adjust the original P to accurately impinge against the roller 3.

Figure 4A:
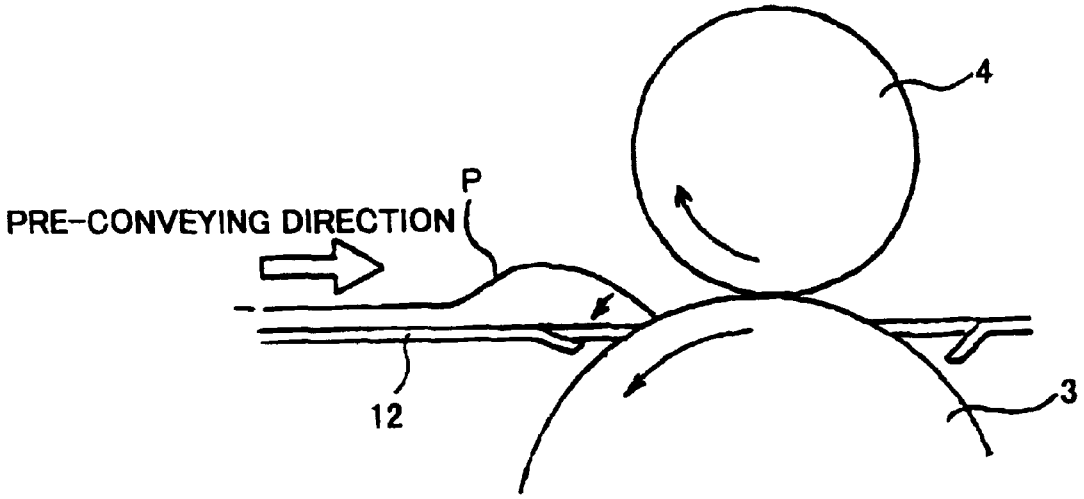
FIGS. 4A and 4B illustrate a state of a leading edge of an original at the original insertion process.
Figure 4B:
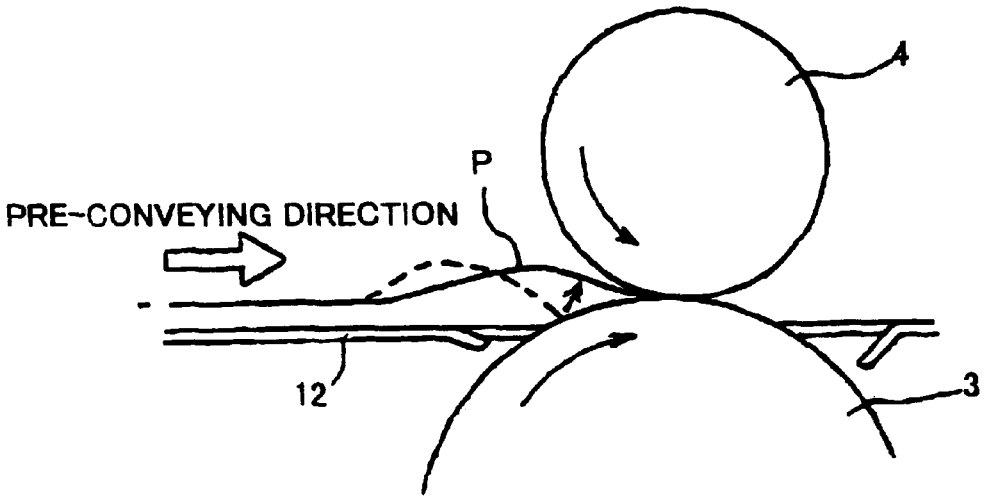

When the rollers 3 and 4 are driven in the reverse direction, the leading edge of the original P having a so-called face-down curl that has impinged against the roller 3 is moved back downwards, as the roller 3 rotates, by the frictional resistance between the roller 3 and the leading edge of the original P, as illustrated in FIG. 4A. The leading edge of the original P separates from the surface of the roller 3 as the roller 3 further rotates, springs back upwards and falls down by its own weight, and thereby the leading edge of the original P impinges against the nip portion, as illustrated in FIG. 4B.

The reverse rotation of the original motor 14 starts 250 ms before the original motor 14 starts the forward rotation, and continues until 100 ms before the motor 14 starts the forward rotation, i.e., the reverse rotation continues for 150 ms. When the time reaches 100 ms before the original motor 14 starts the forward rotation (YES in Step S105), the original motor 14 is once stopped (Step S106). Thereby, the reverse rotation of the roller 3 is stopped while the leading edge of the original P is impinging against the nip portion between the roller 3 and the roller 4. The original insertion process has thus been completed.

The reason why the roller 3 is reversely rotated at the same speed as the exposing speed, which is slower than the pre-conveying speed, is not only because the drive control of the original motor 14 is simplified, but also because the leading edge of the original P is prevented from being damaged by being rubbed by the roller 3 with excessive friction caused by a high speed reverse rotation at the repeat mode.

After expiration of the interval time set in the original insertion timer, i.e., when the time reaches the time to start the forward rotation of the roller 3 (YES in Step S107), the original motor 14 starts the forward rotation and the driving force is transmitted to the roller 3 via the timing belt 19 so as to rotate the roller 3 in the forward direction (Step S108).

When the original P has a so-called face-up curl, which is contrary to the face-down curl illustrated in FIG. 4A, although the leading edge of the original P impinges against the roller 4 and is upwardly moved back as the roller 4 rotates in the reverse direction in the original insertion process, the leading edge of the original P falls down by its own weight when the roller 4 is rotated in the forward direction thereafter. Thus, the leading edge accurately impinges against the nip portions between the entrance drive rollers 3 and corresponding entrance driven rollers 4.

After the pre-conveying operation for the original P has started as described above and after the trailing edge of the original P passes between the contact glass 8 and the exposure guide plate 9 over the reading position above the full-size lens array 17 of the reading section 50, the controller 31 stops the original motor 14 once based on the start sensor 6 turning off. The controller 31 then reversely rotates the original motor 14 to convey the original P in the reverse direction and lights the exposure lamp 16 to expose the conveyed original P for reading the image of the original P in synchronism with a feeding operation of the recording sheet conveying section 70 for the recording sheet P'.

A light reflected from the image of the original P is irradiated to the photoconductor drum 18 through the full-size lens array 17 and an electrostatic latent image is formed on the photoconductor drum 18. The electrostatic latent image is then developed with toner contained in the developing device. The toner image on the photoconductor drum 18 is transferred onto the recording sheet P' with the transfer device and the toner image on the recording sheet P' is fixed with the fixing roller 73 and the pressure roller 74. The recording sheet P' is then discharged out of the main body of the copying machine to a sheet discharging tray (not shown).

On the other hand, the original P is discharged to the original table 1 after the exposing and reading process. When the repeat mode is set and a plurality of copying operations is requested by the user via the operating section 32, the trailing edge of the original P in the reverse direction is kept nipped between the roller 3 and the roller 4 and the forward rotation of the original motor 14 is again started for a second copying operation. The copying operation for the repeat mode is performed by repeating a series of operations of the original motor 14, such as rotating in the forward direction, stopping once, and rotating in the reverse direction (in the exposing and the sheet discharging direction), for the number of copies set by the user.

In the above embodiment, the determination as to whether the reverse rotation of the roller 3 is set is made based upon the determination as to whether the time value N for the reverse rotation of the roller 3 is set. Alternatively, a set/reset key to set or reset the reverse rotation of the roller 3 may be provided in the operating section 32 and setting or resetting of the reverse rotation of the roller 3 can be made by using the set/reset key. Further, the result of setting and resetting of the reverse rotation of the roller 3 may be indicated in the display of the operating section 32. Thus, the operation of either setting or not setting the reverse rotation of the roller 3 by the user becomes simpler. The content of the key operation set in the RAM 35 with the set/reset key is judged in Step S101 in FIG. 3.

According to the first embodiment of the present invention, because the original motor 14 rotates in the reverse direction for a predetermined time when the original P is inserted into the nip portion between the rollers 3 and 4, the leading edge of the original P impinging against a surface of the roller 3 separates from the surface of the roller 3 as the roller 3 further rotates, springs back upwards and falls down by its own weight. Thereby, the leading edge of the original P accurately impinges against the nip portion as described before.

Therefore, even when the original P is thin or has a curl, and in particular a face-down curl, the leading edge of the original P can be impinged against the nip portion straight and damage at the leading edge of the original P does not occur. Thereby, jamming of the original P in the original conveying device 40 is avoided.

Furthermore, because the user can set a usual original conveying operation by eliminating the reverse rotation or the roller 3 in the pre-conveying operation via the operating section 32, when the original P is thick and stiff enough to accurately be inserted into the nip portion between the roller 3 and the roller 4 and is not wrinkled, the original insertion process can be made in a relatively short time. In addition, a needless load applied to the original P by the reverse rotation can be avoided.

Figure 7:
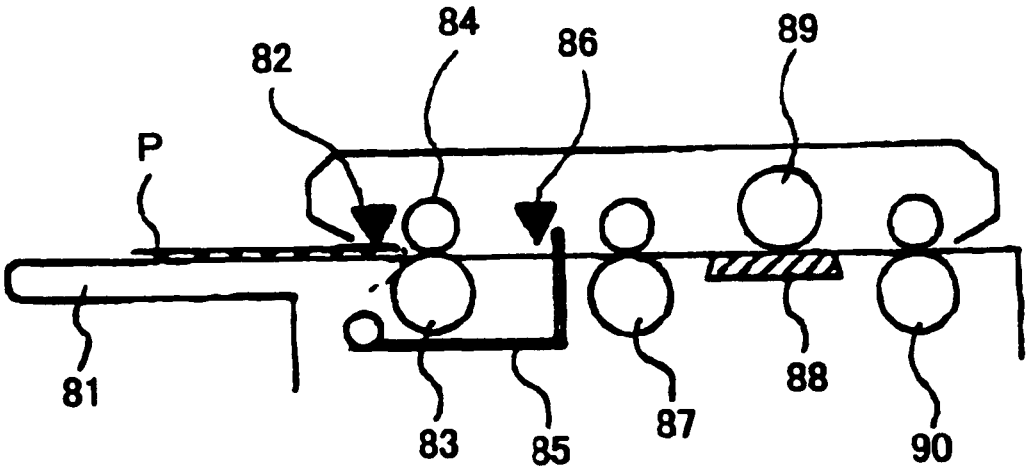
FIG. 7 PRIOR ART
FIG. 7 illustrates a background original conveying device.
Figure 8:
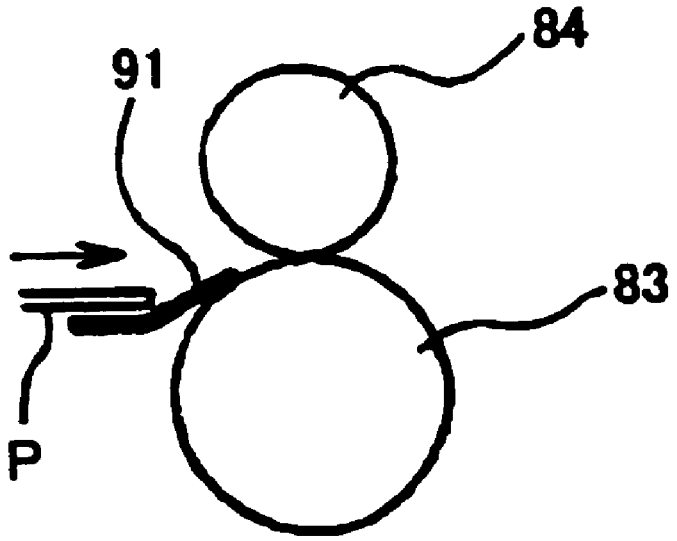
FIG. 8 PRIOR ART
FIG. 8 illustrates a pair of entrance drive and driven rollers including a guide Mylar of another background original conveying device.
Figure 9A:
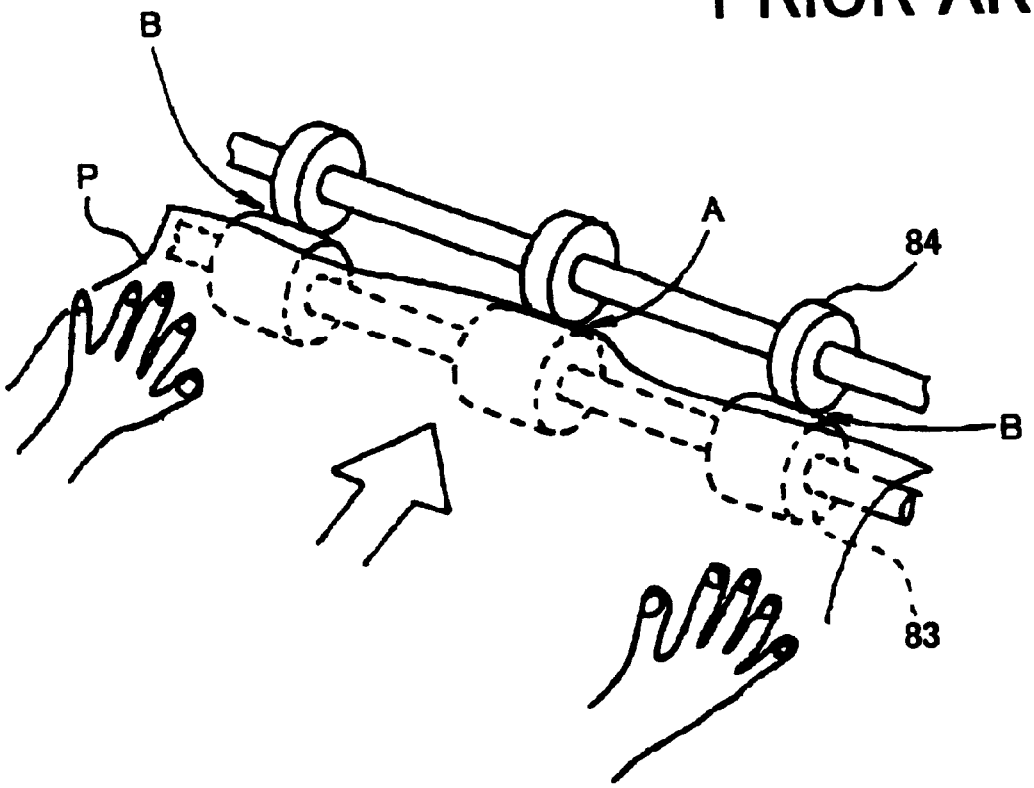
FIG. 9A PRIOR ART
FIGS. 9A and 9B are schematic views for explaining an original inserting operation.
Figure 9B:
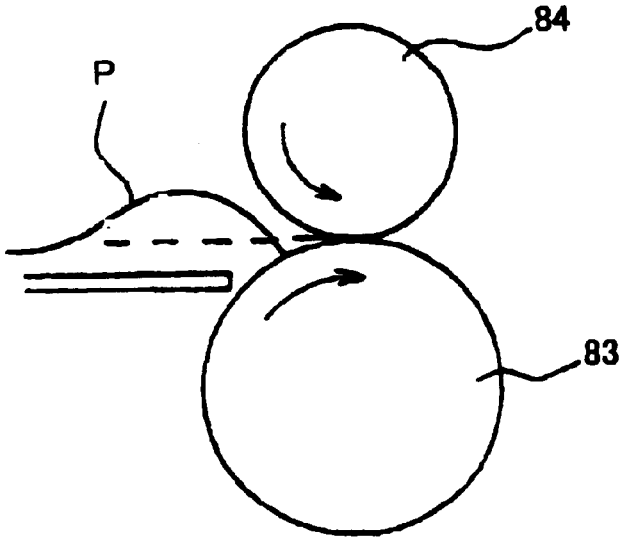
FIG. 9B PRIOR ART

Furthermore, a manufacturing cost is reduced because a stopping nail (such as the stopping nail 85 in FIG. 7), a mechanism to retreat the stopping nail 85, a mechanism to lift up/lower down the roller 4, or a guide positioned adjacent to the roller 3, such as the Mylar 91 as illustrated in FIG. 8, are not required in the original conveying device 40 of the present invention. In addition, because the guide Mylar 91 is not required, jamming of the original P due to an interruption by the guide Mylar 91, does not occur when the original P is conveyed in the reverse direction, i.e., in the exposing and the sheet discharging direction.

Second Embodiment

Figure 5:
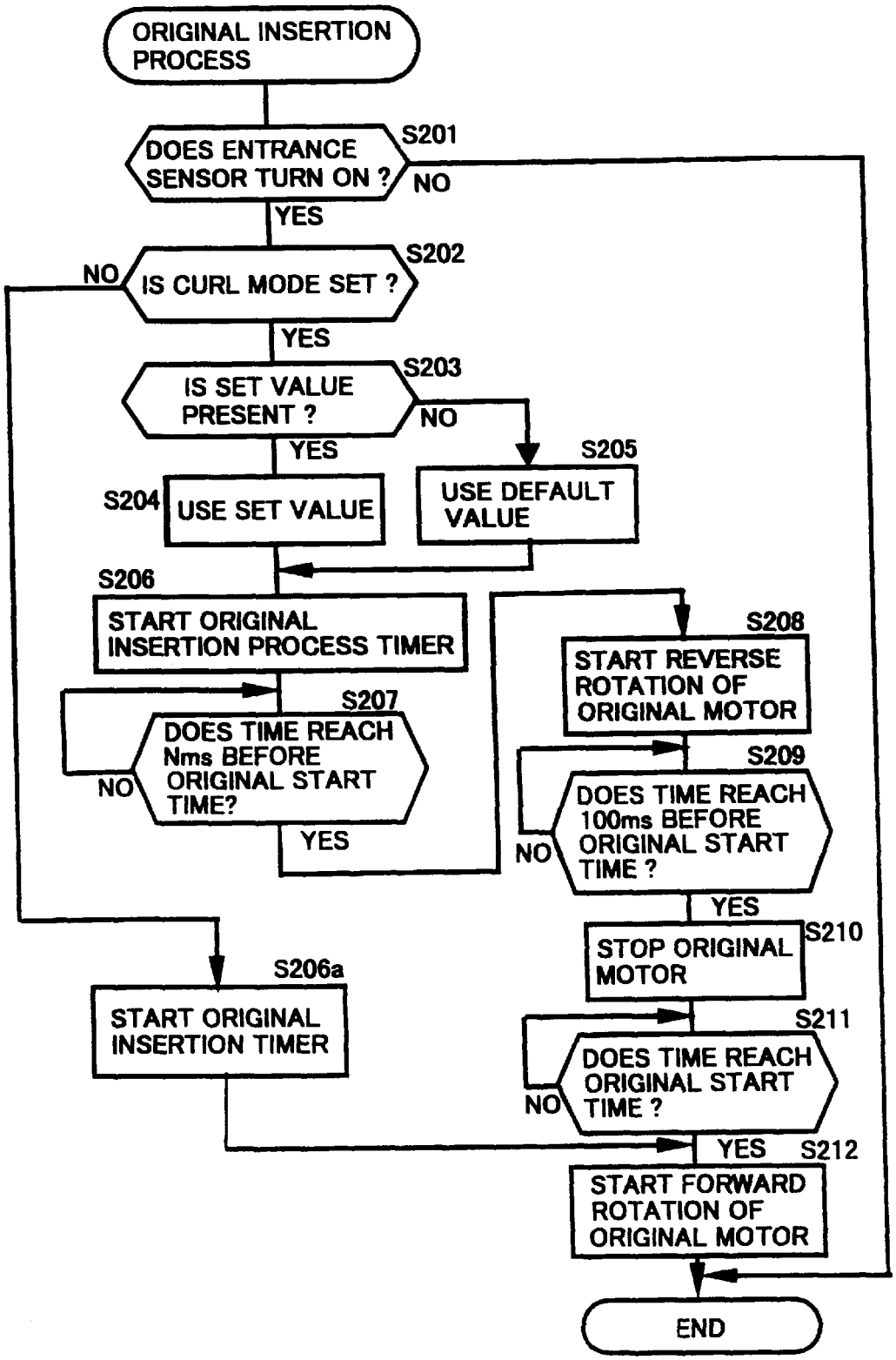
FIG. 5 is a flowchart illustrating another original insertion process of the original conveying device according to the present invention.

FIG. 5 is a flowchart illustrating an original insertion process of an original conveying device of a second embodiment of the present invention. The entire configuration of the original conveying device is substantially the same as that of the first embodiment. The second embodiment is therefore explained referring to FIGS. 1 and 2, and accordingly an explanation of each element already described has been omitted.

The roller 3 starts to rotate in the reverse direction when the pre-conveying operation for the original P is performed based on a time value N. The time value N is stored in a predetermined area of the RAM 35 in the controller 31 as a default value by a user operating of the operating section 32, as in the first embodiment.

In this embodiment, the value N for the reverse rotation can be selectively set by the user. For example, a plurality of steps of the value of N ms may be displayed in a display of the operating section 32, such as, for example, step 1: N=150, step 2: N=250, step 3: N=300, and step 4: N=350. Then, the desired step or value of N can be selected by operating a cursor key or the like in the operating section 32. As a variation, various modes such as a "large curl/small curl" mode, a "thin sheet/thick sheet" mode, or the like, each respectively including a plurality of steps of the values of N as described above, may be displayed and a desired step of a desired mode in the display may be selected by the user.

As another variation, a successive integer, for example an integer from 150 to 350, may be displayed as a "step-less value N" and a desired integer may be selected by the user. Furthermore, after selecting the desired step or integer as mentioned above, a slight adjustment may be performed to the selected step by operating an "add" key or a "subtract" key to add or subtract 50 (ms) at the greatest. For example, when N is 150, the value of N is set as 150±50 (ms).

Alternatively, either a curl mode, in which the reverse rotation of the motor 3 is performed in the pre-conveying operation for the original P, or a non-curl mode, in which the reverse rotation of the motor 3 is not preformed in the pre-conveying operation, can be selectively set from the operating section 32. In addition, either the non-curl mode or the curl mode may be set as a default mode. When the user thus sets the curl mode, the entrance drive motor 3 reversely rotates according to a time value N for the reverse rotation, which is set by the user or is predetermined as the default value.

A setting device that sets an operation to start to rotate the roller 3 in the reverse direction a certain time before rotating the roller 3 in the forward direction and an adjusting device that adjusts the time value based on which the roller 3 starts to rotate in the reverse direction both include the controller 31 and the operating section 32 in the second embodiment.

Next, an original insertion process of the second embodiment is explained referring to FIG. 5.

When a sheet of the original P on the original table 1 is manually inserted from the front side (left side in FIG. 1) of the original conveying device 40 by the user, the entrance sensor 2 turns on by detecting the leading edge of the original P (YES in Step S201). After the entrance sensor 2 turns on, the controller 31 checks whether the curl mode is set (Step S202) and if the curl mode is set (YES in Step S202), the controller 31 further checks whether a time value N for the reverse rotation is set (Step S203). If the set time value is present (YES in Step S203), the controller 31 reads out the set value from the RAM 35 (Step S204). If the set time value is absent (NO in Step S203), the controller 31 reads out the predetermined default value (Step S205). Then, the controller 31 starts the original insertion timer (Step S206).

After a certain time according to the aforementioned set time value N or the predetermined default time value N elapses, the original motor 14 starts rotating in the reverse direction. Namely, when the original insertion timer is set to 2 sec and the value of N is set to, for example, 250 ms, when the time as calculated by the subtraction of 2000−250=1750 (ms) elapses (YES in Step S207), the original motor 14 starts the reverse rotation (Step S208). That is, the time for the user to set the original P (the time while the original motor 14 is waiting for the start of rotation) is 1750 ms. The rotating force generated by the motor 14 is transmitted to the roller 3 via the timing belt 19 and the roller 3 rotates in the reverse rotation. The leading edge of the original P impinges against the roller 3, separates from the surface of the roller 3 as the roller 3 further rotates, springs back upwards and falls down by its own weight. Thereby, the leading edge of the Original P impinges against the nip portion as illustrated in FIG. 4B.

The above-described reverse rotation of the original motor 14 is performed for a predetermined time and stops at a predetermined time (Step S209), for example, 100 ms, before the start time to start forward rotation. For example, when the value of N is set as N=250, the reverse rotation of the original motor 14 is performed for the predetermined time of 150 ms, which is calculated by a subtraction, 250−100 (ms). That is, the original motor 14 stops once when the time reaches 100 ms before starting the forward rotation (Step S210). The reverse rotation of the roller 3 stops while the leading edge of the original P is being impinged against the nip portion between the roller 3 and the roller 4. The original insertion process has thus been completed.

The controller 31 then waits while counting the original insertion timer. When the time reaches the time to start rotating the roller 3 in the forward direction (YES in Step S211), the original motor 14 starts a forward rotation (Step S212) and a driving force of the motor 14 is transmitted to the roller 3 via the timing belt 19. Consequently, the roller 3 starts rotation in the forward direction.

On the other hand, when the curl mode is not set in the predetermined area in the RAM 35 (NO in Step S202), the controller 31 judges that the reverse rotating operation is not set. The controller 31 starts the original insertion timer (Step S206*a*), and after expiration of the interval time set in the original insertion timer (i.e., when the time reaches the time to start the forward rotation of the roller 3), the original motor 14 starts the forward rotation of the roller 3 (Step S212).

After the trailing edge of the original P passes through the reading position just above the full-size lens array 17 of the reading section 50 and when the trailing edge of the original P is detected by the start sensor 6, the controller 31 temporarily stops the original motor 14 based on the start sensor 6 turning off. Then, the controller 31 changes the rotating direction of the original motor 14 in the reverse direction, in synchronism with the feeding operation for the recording sheet P' performed by the recording sheet conveying section 70. Thus, the original P is conveyed in the reverse direction and at the same time the controller 31 lights the exposure lamp 16. Consequently, the image surface of the original P is read by the reading section 50 and the image forming operation is performed as described earlier. When the repeat mode is set and a plurality of copying operations are requested by the user via the operating section 32, the trailing edge of the original P in the reverse direction is kept nipped between the rollers 3 and 4 and the forward rotation of the original motor 14 is again started for the second copying operation.

According to the second embodiment, the reverse rotation for the roller 3 in the pre-conveying operation can be set by selecting the curl mode. Further, the time value based on which the reverse rotation starts can be flexibly set by selecting a desired value or the default value. Therefore, the time period of the reverse rotation, (i.e., the amount of the reverse rotation) can be appropriately adjusted on the basis of a level of the thickness or a degree of the curl of the original P.

Third Embodiment

The entire configuration of the third embodiment is substantially the same as that illustrated in FIG. 1. The third embodiment is therefore explained referring to FIG. 1 and the explanation has been omitted of each element discussed above.

Figure 6A:
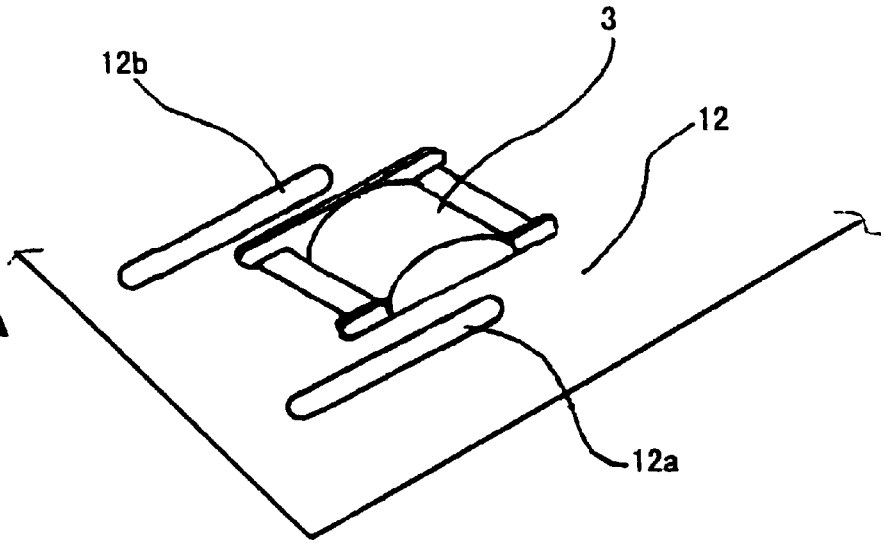
FIGS. 6A–6C illustrate a guide plate of the original conveying device according to another embodiment of the present invention.
Figure 6B:
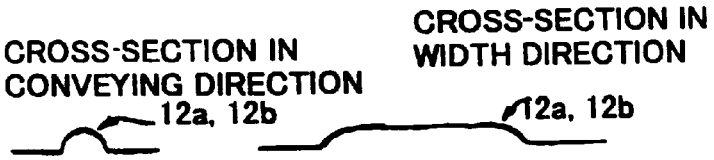
Figure 6C:
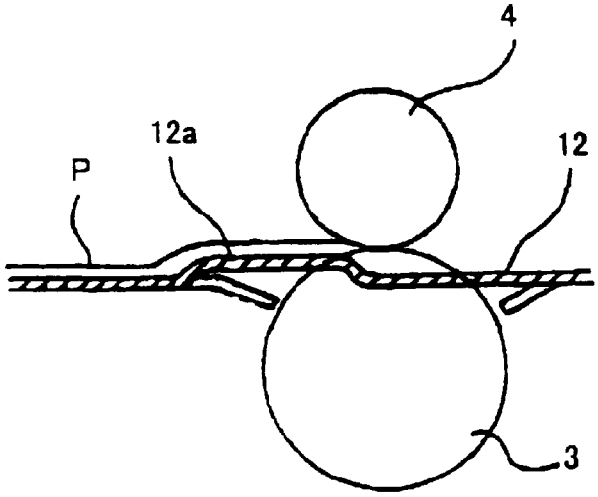

FIGS. 6A to 6C illustrate a guide plate of an original conveying device 40 according to the third embodiment of the present invention. FIG. 6A is a perspective view illustrating the vicinity of convex portions 12*a* and 12*b*, and FIG. 6B illustrates cross-sectional views of the convex portions 12*a* and 12*b* viewed in sheet conveying and widthwise directions, respectively. FIG. 6C is a cross-sectional view illustrating a positional relationship between the convex portion 12*a* and an original P.

As illustrated in FIG. 6A, the convex portions 12*a* and 12*b* are formed in a front guide plate 12 in the vicinity of the sides of a roller 3, respectively. These convex portions 12*a* and 12*b* are formed in parallel and extend from an upstream position of the roller 3 in a original conveying direction to the nip portion between the rollers 3 and 4 (not shown), or across the nip, as illustrated in FIG. 6A.

Furthermore, as illustrated in FIG. 6C, both heights of the convex portions 12*a* and 12*b* are set lower than a height of the roller 3 that projects from a surface of the front guide plate 12. The respective convex portions 12*a* and 12*b* are formed in a half-round shape in the cross section in the direction orthogonal to the conveying direction of the original P and in an approximately trapezoid shape in the cross section in the conveying direction of the original P. The shapes of the convex portions are not limited to the shapes described above and the convex portions can be formed in any shape, by which a leading edge of the original P is deflected upwards and then falls down by its own weight on the convex portions 12*a* and 12*b* before impinging against the roller 3.

By forming the convex portions 12*a* and 12*b* as above, the leading edge of the original P can be guided so as to be accurately impinged against the nip portion. In addition, by combining the above described configuration of the convex portions 12*a* and 12*b* according to the third embodiment and the reverse rotating operation of the roller 3 described before, the original P can be more accurately impinged against the nip portion of the roller 3.

The configuration of the convex portions 12*a* and 12*b* on the front guide plate 12 is simpler than that of a mechanism to provide a guide Mylar such that the end thereof contacts an upper part of a surface of an entrance drive roller as in the background art. Further, jamming of an original P does not occur even when the original P is repeatedly conveyed in the forward direction and reversed for making a plurality of copies or when the original P is discharged in the reverse direction to the sheet discharging tray 1.

The present invention can be applied, besides the original conveying device 40 described above, to sheet conveying devices for a recording sheet or the like.

When the present invention is applied to the recording sheet conveying section 70 of FIG. 1, the reverse rotation of the recording sheet entrance drive roller 71*b* may be set in a similar manner as in the reverse rotation in the pre-conveying operation of the original conveying device 40. Thereby, the impinging operation of the recording sheet P' against the nip portion between the entrance drive roller 71*b* and entrance driven roller 71*a* can be appropriately adjusted on the basis of a level of a thickness of the recording sheet P' or the level of a curl when the recording sheet P' is manually inserted by the user into the nip portion between the entrance drive roller 71*b* and the entrance driven roller 71*a* from the front side (left side in FIG. 1) of the sheet conveying device.

Further, convex portions may be formed in a recording sheet table 70*a* in the vicinity of the sides of the recording sheet entrance drive roller 71*b* in a shape similar to that of the aforementioned convex portions 12*a* and 12*b*. The convex portions may be formed in a parallel and extend from a position adjacent to an upstream of the recording sheet entrance drive roller 71*b* in a conveying direction of the recording sheet to the nip portion (nip line) between the rollers 71*b* and 71*a*.

The user can accurately impinge the leading edge of the recording sheet P' against the nip portion between the rollers 71*a* and 71*b* from the front side (left side in FIG. 1) in the similar manner as for the original P in the third embodiment of the present invention when the user manually inserts the recording sheet P' into the nip portion.

As illustrated in FIG. 1 and FIGS. 6A to 6C, only the front guide plate 12 to guide the leading edge of the original P to the roller 3 is provided and a guide plate to guide the original P to the roller 4 is not provided. This is because even when the original P has a face-up curl, the leading edge of the original P can be accurately impinged against the nip line between the rollers 3 and corresponding rollers 4 by adopting resin material having a small frictional resistance, such as plastic or the like, as the material of the entrance driven roller 4. When material having high frictional resistance is adopted as the material of the roller 4, a guide plate similar to the front guide plate 12 may be provided above the front guide plate 12 (i.e., at the side of the roller 4).

Obviously, numerous modifications and variations of the present invention are possible in light of the above teachings. It is therefore to be understood that within the scope of the appended claims, the invention may be practiced otherwise than as specifically described herein.

This document claims priority and contains subject matter related to Japanese Patent Application No. 10-193298, filed on Jul. 7, 1998, and Japanese Patent Application No. 11-150722, filed on May 28, 1999, and the entire contents thereof are herein incorporated by reference.

What is claimed is:

1. A sheet conveying device comprising:

a pair of rollers configured to convey a sheet impinged against a nip portion of the pair of rollers;

a driving device configured to drive the pair of rollers to rotate in one of a forward direction and a reverse direction;

a sheet detecting device configured to detect the sheet inserted into the nip portion; and a controller configured to control the pair of rollers to rotate in the reverse direction by a predetermined amount of rotation when a leading edge of the sheet impinges against at least one roller of the pair of rollers and configured to then rotate the pair of rollers in the forward direction when the leading edge of the sheet is impinged into the nip portion.

2. The sheet conveying device according to claim 1, further comprising:

a setting device configured to set an operation of rotating the pair of rollers to rotate in the reverse direction by the predetermined amount of rotation when the sheet is inserted into the nip portion.

3. The sheet conveying device according to claim 1, further comprising:

an adjusting device configured to adjust the predetermined amount of rotation of the pair of rollers in the reverse direction.

4. The sheet conveying device according to claim 1, further comprising:

a guide plate configured to guide the sheet to the nip portion, wherein at least one convex portion is formed in the guide plate in a vicinity of the nip portion.

5. The sheet conveying device according to claim 4, wherein the convex portion is formed at each side of the pair of rollers and extend from an upstream position of the pair of rollers to the nip portion in a sheet conveying direction.

6. A sheet conveying device comprising:

a plurality of roller pairs configured to convey a sheet impinged against each nip portion thereof, the plurality of roller pairs being arranged in parallel with each other and aligned in a direction perpendicular to a sheet conveying direction;

a driving device configured to drive the plurality of roller pairs to rotate in one of a forward direction and a reverse direction;

a sheet detecting device configured to detect the sheet inserted into said each nip portion; and a controller configured to control the driving device to drive the plurality of roller pairs to rotate in the reverse direction by a predetermined amount of rotation a predetermined time when a leading edge of the sheet impinges against at least one roller of the plurality of roller pairs and configured to then rotate the plurality of roller pairs in the forward direction when the leading edge of the sheet is impinged into said each nip portion.

7. An image reading apparatus, comprising:

a first pair of rollers configured to convey an original impinged against a nip portion of the first pair of rollers in a pre-conveying direction;

a second pair of rollers configured to convey the original having been conveyed in the pre-conveying direction in a reverse direction relative to the pre-conveying direction to a reading position at a speed slower than when conveyed in the pre-conveying direction;

an original reading device configured to read the original conveyed to the reading position;

a driving device configured to drive the first pair of rollers and the second pair of rollers to rotate in one of a forward direction and a reverse direction;

an original detecting device configured to detect the original inserted into the nip portion of the first pair of rollers; and a controller configured to control the first pair of rollers to rotate in the forward direction after rotating the first pair of rollers in the reverse direction by a predetermined amount of rotation when the original is inserted into the nip portion of the first pair of rollers, wherein the speed at which the original is conveyed in the reverse direction when the original is inserted into the nip portion of the first pair of rollers is substantially the same as that at which the original is conveyed in the reverse direction to the reading position.

8. An image reading apparatus comprising:

a sheet conveying device including:

a pair of rollers configured to convey a sheet impinged against a nip portion of the pair of rollers;

a driving device configured to drive the pair of rollers to rotate in one of a forward direction and a reverse direction;

a sheet detecting device configured to detect the sheet inserted into the nip portion; and a controller configured to control the pair of rollers to rotate in the reverse direction by a predetermined amount of rotation when a leading edge of the sheet impinges against at least one roller of the pair of rollers and configured to then rotate the pair of rollers in the forward direction when the leading edge of the sheet is impinged into the nip portion of the pair of rollers.

9. The image reading apparatus according to claim 8, wherein the sheet conveying device further includes:

a setting device configured to set an operation of rotating the pair of rollers to rotate in the reverse direction by the predetermined amount of rotation when the sheet is inserted into the nip portion.

10. The image reading apparatus according to claim 8, wherein the sheet conveying device further includes:

an adjusting device configured to adjust the predetermined amount of rotation of the pair of rollers in the reverse direction.

11. The image reading apparatus according to claim 8, wherein the sheet conveying device further includes:

a guide plate configured to guide the sheet to the nip portion, wherein at least one convex portion is formed in the guide plate in a vicinity of the nip portion.

12. The image reading apparatus according to claim 11, wherein the convex portion is formed at each side of the pair of rollers and extend from an upstream position of the pair of rollers to the nip portion in a sheet conveying direction.

13. An image reading apparatus comprising:

a sheet conveying device including:

a plurality of roller pairs configured to convey a sheet impinged against each nip portion thereof, the plurality of roller pairs being arranged in parallel with each other and aligned in a direction perpendicular to a sheet conveying direction;

a driving device configured to drive the plurality of roller pairs to rotate in one of a forward direction and a reverse direction;

a sheet detecting device configured to detect the sheet inserted into said each nip portion; and a controller configured to control the driving device to drive the plurality of roller pairs to rotate in the reverse direction by a predetermined amount of rotation a predetermined time when a leading edge of the sheet impinges against at least one roller of the plurality of roller pairs and configured to then rotate the plurality of roller pairs in the forward direction when the leading edge of the sheet is impinged into said each nip portion.

14. An image forming apparatus comprising:

a sheet conveying device including;

a pair of rollers configured to convey a sheet impinged against a nip portion of the pair of rollers;

a driving device configured to drive the pair of rollers to rotate in one of a forward direction and a reverse direction;

a sheet detecting device configured to detect the sheet inserted into the nip portion; and a controller configured to control the pair of rollers to rotate in the reverse direction by a predetermined amount of rotation when a leading edge of the sheet impinges against at least one roller of the pair of rollers and configured to then rotate the pair of rollers in the forward direction when the leading edge of the sheet is impinged into the nip portion of the pair of rollers.

15. The image forming apparatus according to claim 14, wherein the sheet conveying device further includes:

a setting device configured to set an operation of rotating the pair of rollers to rotate in the reverse direction by the predetermined amount of rotation when the sheet is inserted into the nip portion.

16. The image forming apparatus according to claim 14, wherein the sheet conveying device further includes:

an adjusting device configured to adjust the predetermined amount of rotation of the pair of rollers in the reverse direction.

17. The image forming apparatus according to claim 14, wherein the sheet conveying device further includes:

a guide plate configured to guide the sheet to the nip portion, wherein at least one convex portion is formed in the guide plate in a vicinity of the nip portion.

18. The image forming apparatus according to claim 17, wherein the convex portion is formed at each side of the pair of rollers and extend from an upstream position of the pair of rollers to the nip portion in a sheet conveying direction.

19. An image forming apparatus comprising:

a sheet conveying device including;

a plurality of roller pairs configured to convey a sheet impinged against each nip portion thereof, the plurality of roller pairs being arranged in parallel with each other and aligned in a direction perpendicular to a sheet conveying direction;

a driving device configured to drive the plurality of roller pairs to rotate in one of a forward direction and a reverse direction;

a sheet detecting device configured to detect the sheet inserted into said each nip portion; and a controller configured to control the driving device to drive the plurality of roller pairs to rotate in the reverse direction by a predetermined amount of rotation a predetermined time when a leading edge of the sheet impinges against at least one roller of the plurality of roller pairs and configured to then rotate the plurality of roller pairs in the forward direction when the leading edge of the sheet is impinged into said each nip portion.

20. A sheet conveying device comprising:

a pair of rollers for conveying a sheet impinged against a nip portion of the pair of rollers;

means for driving the the pair of rollers to rotate in one of a forward direction and a reverse direction;

means for detecting the sheet inserted into the nip portion of the pair of rollers; and means for controlling the pair of rollers to rotate in the reverse direction by a predetermined amount of rotation when a leading edge of the sheet impinges against at least one roller of the pair of rollers and configured to then rotate the pair of rollers in the forward direction when the leading edge of the sheet is impinged into the nip portion.

21. The sheet conveying device according to claim 20, further comprising:

means for setting an operation of rotating the conveying means to rotate in the reverse direction by the predetermined amount of rotation when the sheet is inserted into the nip portion.

22. The sheet conveying device according to claim 20, further comprising:

means for adjusting the predetermined amount of rotation of the conveying means in the reverse direction.

23. The sheet conveying device according to claim 20, further comprising:

means for guiding a sheet to the nip portion, wherein at least one convex portion is formed in the guiding means in a vicinity of the nip portion.

24. The sheet conveying device according to claim 23, wherein the convex portion is formed at each side of the conveying means extending from an upstream position of the conveying means to the nip portion in a sheet conveying direction.

25. A sheet conveying device comprising:

a plurality of roller pairs for conveying a sheet impinged against each nip portion thereof, the plurality of roller pairs being arranged in parallel with each other and aligned in a direction perpendicular to a sheet conveying direction;

means for driving the plurality of roller pairs to rotate in one of a forward direction and a reverse direction;

means for detecting the sheet inserted into said each nip portion; and means for controlling the driving device to drive the plurality of roller pairs to rotate in the reverse direction by a predetermined amount of rotation a predetermined time when a leading edge of the sheet impinges against at least one roller of the plurality of roller pairs and configured to then rotate the plurality of roller pairs in the forward direction when the leading edge of the sheet is impinged into said each nip portion.

26. An image reading apparatus, comprising:

a first means for conveying an original impinged against a nip portion of the first conveying means in a pre-conveying direction;

a second means for conveying the original having been conveyed in the pre-conveying direction in a reverse direction relative to the pre-conveying direction to a reading position, at a speed slower than when conveyed in the pre-conveying direction;

means for reading the original conveyed to the reading position;

means for driving the first conveying means and the second conveying means to rotate in one of a forward direction and a reverse direction;

means for detecting the original inserted into the nip portion of the first conveying means; and means for controlling the first conveying means to rotate in a forward direction after rotating the first conveying means in the reverse direction by a predetermined amount of rotation when the original is inserted into the nip portion of the first conveying means, wherein the speed at which the original is conveyed in the reverse direction when the original is inserted into the nip portion of the first conveying means is substantially the same as that at which the original is conveyed in the reverse direction to the reading position.

27. A method of conveying a sheet comprising:

conveying a sheet impinged against a nip portion of a pair of rollers;

driving the pair of rollers to rotate in one of a forward direction and a reverse direction;

detecting the sheet inserted into the nip portion; and controlling the pair of rollers to rotate in the reverse direction by a predetermined amount of rotation when a leading edge of the sheet impinges against at least one roller of the pair of rollers and configured to then rotate the pair of rollers in the forward direction when the leading edge of the sheet is impinged into the nip portion.

28. The method according to claim 27, further comprising:

setting an operation of rotating the pair of rollers to rotate in the reverse direction by the predetermined amount of rotation when the sheet is inserted into the nip portion.

29. The method according to claim 27, further comprising:

adjusting the predetermined amount of rotation of the pair of rollers in the reverse direction.

30. The method according to claim 27, further comprising:

guiding, via a guide plate, a sheet to the nip portion; and forming at least one convex portion in the guiding plate in a vicinity of the nip portion.

31. The method according to claim 30, wherein the convex portion is formed at each side of the pair of rollers and extends from an upstream position of the pair of rollers to the nip portion in a sheet conveying direction.

32. A method of conveying a sheet comprising:

conveying a sheet impinged against each nip portion of a plurality of roller pairs, the plurality of roller pairs being arranged in parallel with each other and aligned in a direction perpendicular to a sheet conveying direction;

driving the plurality of roller pairs to rotate in one of a forward direction and a reverse direction;

detecting the sheet inserted into said each nip portion; and controlling the plurality of roller pairs to rotate in the reverse direction by a predetermined amount of rotation a predetermined time when a leading edge of the sheet impinges against at least one roller of the plurality of roller pairs and configured to then rotate the plurality of roller pairs in the forward direction when the leading edge of the sheet is impinged into said each nip portion.

33. A method of conveying a sheet comprising:

conveying an original impinged against a nip portion of a first pair of rollers in a pre-conveying direction;

conveying, via a second pair of rollers, the original having been conveyed in the pre-conveying direction in a reverse direction relative to the pre-conveying direction to a reading position, at a speed slower than when conveyed in the pre-conveying direction;

reading the original conveyed to the reading position;

driving the first and second pair of rollers to rotate in one of a forward direction and a reverse direction;

detecting the original inserted into the nip portion of the first pair of rollers; and controlling the first pair of rollers to rotate in the forward direction after rotating the first pair of rollers in the reverse direction by a predetermined amount of rotation when the original is inserted into the nip portion of the first pair of rollers, wherein the speed at which the original is conveyed in the reverse direction when the original is inserted into the nip portion of the first pair of rollers is substantially the same as that at which the original is conveyed in the reverse direction to the reading position.

* * * * *

UNITED STATES PATENT AND TRADEMARK OFFICE

CERTIFICATE OF CORRECTION

PATENT NO. : 6,185,403 B1
DATED : February 6, 2001
INVENTOR(S) : Yoshio Toyoshima, et al.

It is certified that error appears in the above-identified patent and that said Letters Patent is hereby corrected as shown below:

Title page,
The CPA information has been omitted. It should read as follows:

-- [45] Date of Patent *Feb. 6, 2001

(*) Notice: This Patent issued on a continued prosecution application filed under 37 CFR 1.53(d), and is subject to the twenty year patent term provisions of 35 U.S.C. 154(a)(2) --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*